United States Patent [19]

Giersch et al.

[11] Patent Number: 4,872,274

[45] Date of Patent: Oct. 10, 1989

[54] REMOVABLE TOOTH WITH ADAPTER FOR DIGGING EXCAVATORS

[75] Inventors: Dieter Giersch, Glückstadt; Hans-Werner Rickmann, Witten; Ulrich Wibbeling, Dortmund, all of Fed. Rep. of Germany

[73] Assignee: Hoesch Aktiengesellschaft, Dortmund, Fed. Rep. of Germany

[21] Appl. No.: 244,707

[22] Filed: Sep. 15, 1988

[30] Foreign Application Priority Data

Sep. 18, 1987 [DE] Fed. Rep. of Germany ..... 3731459

[51] Int. Cl.[4] ..... E02F 3/88; E02F 9/28

[52] U.S. Cl. ..... 37/64; 37/142; 403/33

[58] Field of Search ..... 37/142 R, 142 A, 141 R, 37/141 T, 64, 70, 188, 189; 403/334, 333

[56] References Cited

U.S. PATENT DOCUMENTS

| | | | |
|---|---|---|---|
| 2,159,104 | 5/1939 | Ratkowski | 37/142 R |
| 3,897,642 | 8/1975 | Helton et al. | 37/142 R |
| 4,470,210 | 9/1984 | Hahn | 37/142 R |
| 4,625,439 | 12/1986 | Johansson et al. | 37/142 R |

FOREIGN PATENT DOCUMENTS

| | | | |
|---|---|---|---|
| 2534910 | 2/1976 | Fed. Rep. of Germany | 37/142 R |

*Primary Examiner*—Edgar S. Burr
*Assistant Examiner*—Moshe I. Cohen
*Attorney, Agent, or Firm*—Max Fogiel

[57] ABSTRACT

A removable tooth with an adapter, said tooth having a wear-subject section that is as thick as possible in relation to the overall mass. The adapter being exposed to only a little wear. The transmission of force from the point of the tooth to a cutting wheel by way of the adapter, minimizes the need for securing mechanisms.

7 Claims, 1 Drawing Sheet

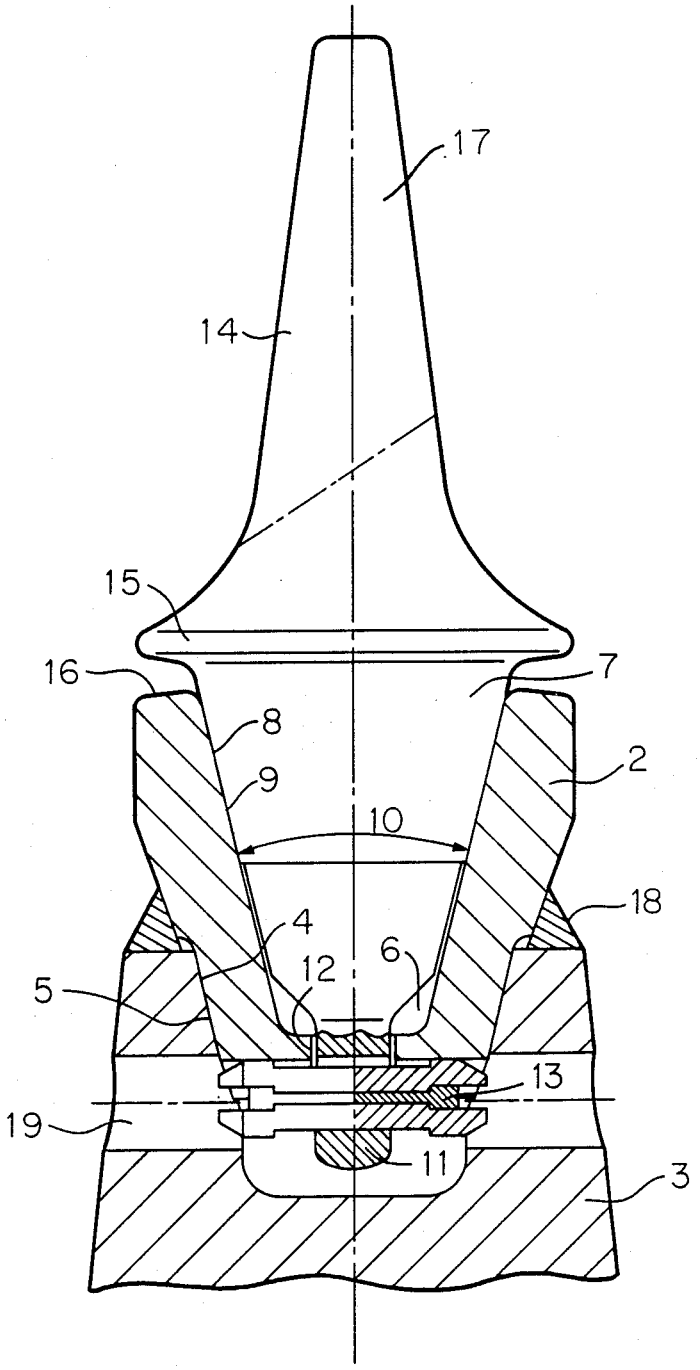
17
14
15
16
7
8
2
9
10
18
4
6
12
5
13
19
11
3

REMOVABLE TOOTH WITH ADAPTER FOR DIGGING EXCAVATORS

The invention concerns a removable tooth with an adapter for excavators as recited in the preamble to claim 1.

Teeth of this type are employed with suction dredges or power shovels in particular. Removable teeth are, however, also employed on the shovels of conventional excavators. Since they are subject to wear, the teeth are removable and, once they have become worn, can be replaced with new or overhauled teeth. It is attempted to keep the wear-subject section of the teeth as thick as possible in relation to their overall mass and to design the accommodating structure as free of wear as possible.

An adapter for accommodating the tooth is conventionally positioned on the cutting wheel or shovel. German Patent Disclosure 3 413 334 discloses a cutting head with an adapter and removable tooth. The adapter in the design disclosed therein consists of two components, with the basic component welded directly to the cutting head, another component, the adapter component, attached to the basic component, and the point of the tooth fitting over the adapter and secured to it. A similar system is disclosed in German Patent 3 113 342. The adapter in this embodiment is in one piece and is welded directly to the cutting wheel. Tooth-adapter systems of this known type have a tooth that is hollow in the vicinity of attachment, into which the adapter connection locks. Since the wear-subject section of these teeth is thin in relation to the overall mass, a lot of material is thrown away unconsumed once the point of the tooth has worn out.

German Patent Exposure 3 427 610 discloses a tooth-adapter system for earth-moving machinery of the type employed with power shovels. FIGS. 1 through 4 illustrate an attaching system wherein the base of the tooth is secured in an opening in an adapter. That type of tooth adapter, however, cannot be employed with the cutting wheels of suction dredges or power shovels because the adapter must extend very far over the accommodating surface and is accordingly exposed to severe wear.

The object of the invention is accordingly to provide a removable tooth of the aforesaid type with a wear-subject section that is as thick as possible in relation to the overall mass, whereby the adapter is exposed to only a little wear. Furthermore, the transmission of force from the point of the tooth to the cutting wheel by way of the adapter should be as satisfactory as possible, minimizing the need for securing mechanisms.

This object is attained in accordance with the invention by the characteristics recited in the preamble to claim 1. Advantageous and practical embodiments are recited in the bodies of claims 1 through 7.

The advantages attained in accordance with the invention consist in the thick wear-subject section of the tooth and especially in the satisfactory transmission of cutting forces from the point of the tooth to the cutting wheel by way of the adapter, resulting in an adapter that takes up very little space. The resulting adapter extends only very slightly over the cutting wheel and is accordingly exposed to only very slight wear. Another advantage is that all the components are easy to manufacture and that, when the component that accommodates the tooth does wear out, it is very easy to overhaul. Furthermore, the adapter can very easily be removed from the cutting wheel when it exhibits overwhelming wear or when it breaks, and a new adapter can be secured to the wheel.

One embodiment of the invention will now be specified with reference to the drawing.

A cutting wheel 3 has a recess 5 for accommodate an adapter 2. Recess 5 is initially conical and cylindrical at the bottom. Adapter 2 is inserted into the recess and accordingly has a lateral surface 4 in the form of a truncated cone with the same angle as the conical section of the recess, which it matches. The surface of adapter 2 above cutting wheel 3 can be any desired shape. The surface in the illustrated embodiment is designed to allow adapter 2 to be secured to cutting wheel 3 by means of a welded seam 18. It is, however, also conceivable although not illustrated for adapter 2 to be screwed onto or forced into cutting wheel 3.

Adapter 2 has an opening 6 for accommodating a tooth 1. The opening 6 in the illustrated embodiment is also in the shape of a truncated cone and merges at the bottom into a rectangular recess 12. The opening 6 in adapter 2 supports the base 7 of tooth 1. Foot 7 is in the form of the frustum of a cone and has a supporting surface 8 that rests against a matching contact surface 9 on adapter 2. The angle 10 of the truncated cone in base 7 and of the opening 6 in adapter 2 is 27° in the illustrated embodiment. To ensure that the lateral forces that act on tooth 1 are transmitted in a beneficial range to adapter 2, the total surface of base 7 rests against the adapter only at the top.

To secure it in position and to accommodate a security component 13, the bottom 11 of the base 7 of tooth 1 is rectangular in cross-section, at which point it engages the corresponding rectangular recess 12 in adapter 2. Security component 13 is also accessible at this point through an opening 19 in cutting wheel 3. Between the point 14 and the base 7 of the tooth is a collar 15.

The outside diameter of collar 15 equals the outside diameter of adapter 2, and the collar is positioned slightly above the upper edge 16 of the adapter. The wear-subject section 17 of tooth 1 is represented by a dot-and-dash line of demarcation. The wear-subject section of even a small tooth will, as is evident from the drawing, occupy a large proportion of its total mass.

We claim:

1. A removable tooth with an adapter for a cutting wheel on suction dredges or power shovels, comprising: a cutting wheel: an adapter attached to the cutting wheel and having similarly shaped surfaces for supporting the tooth; said cutting wheel having a recess with a circumference and length for receiving said adapter; said adapter having a lateral outer surface in contact with said recess over the entire circumference of said recess and along at least part of the length of said recess; said adapter being fixed in said recess; said tooth having a base; said adapter having an opening for supporting said tooth on said base; said tooth extending with said base into said opening of said adapter and said adapter extending into said recess of said cutting wheel; and including a security element at said bottom of said base of said tooth, said security element extending through said base and through said adapter, said security element being accessible from outside through said cutting wheel.

2. A removable tooth as defined in claim 1, wherein said base of said tooth is at least partly shaped as a truncated cone, said adapter opening comprising a conical bore matching substantially said shape of said base, said base resting in said matching conical bore.

3. A removable tooth as defined in claim 1, wherein said lateral surface of said adapter comprises at least partly the shape of a truncated cone, said recess in said cutting wheel comprising a conical bore matching substantially said shape of said lateral surface, said lateral surface resting in said matching conical bore in said cutting wheel.

4. A removable tooth as defined in claim 2, wherein said truncated cone at said base of said tooth has an angle of 20 to 30 degrees, said conical bore in said adapter having substantially the same angle of 20 to 30 degrees.

5. A removable tooth as defined in claim 1, wherein said base of said tooth has a bottom with a polygonal cross-section, said adapter having a rectangular recess matching substantially said polygonal cross-section said bottom engaging said rectangular recess.

6. A removable tooth as defined in claim 1, including a collar on said tooth between said base and predetermined point on said tooth, said collar having an outside diameter, said adapter having an outside diameter equal substantially to said outside diameter of said collar, said adapter having an upper edge, said collar being positioned substantially above said upper edge of said adapter.

7. A removable tooth with an adapter for a cutting wheel on suction dredges or power shovels, comprising: a cutting where; an adapter attached to the cutting wheel and having similarly shaped surfaces for supporting the tooth; said cutting wheel having a recess with a circumference and length of receiving said adapter; said adapter having a lateral outer surface in contact with said recess over the entire circumference of said recess and along at least part of the length of said recess; said adapter being fixed in said recess; said tooth having a base; said adapter having an opening for supporting said tooth on said base; said tooth extending with said base into said opening of said adapter and said adapter extending into said recess of said cutting wheel; and base of said tooth being shaped at least partly as a truncated cone, said adapter having a conical bore matching substantially said truncated cone, said truncated cone resting in said matching conical bore, said bore comprising said opening in said adapter; said lateral surface of said adapter being shaped at least partly as a truncated cone, said recess in said cutting wheel having a conical shape matching substantially said truncated cone of said lateral surface, said lateral surface resting in said recess of said cutting wheel; said base having a bottom with a polygonal cross-section, said adapter having a rectangular recess engaging said polygonal cross-section; a security element at said bottom of said base and extending through said base and through said adapter, said security element being accessible from outside through said cutting wheel; a collar on said tooth between said base and a predetermined point on said tooth, said collar having an outside diameter, said adapter having an outside diameter equal substantially to said outside diameter of said collar, said collar being positioned substantially above an upper edge of said adapter.

* * * * *